US006819772B2

(12) United States Patent
Amae

(10) Patent No.: US 6,819,772 B2
(45) Date of Patent: Nov. 16, 2004

(54) PERSONAL AUDIO-SET WITH PIVOTING EAR CLIP MOUNT

(75) Inventor: Dominic Amae, Aloha, OR (US)

(73) Assignee: Logitech Europe S.A., Romanel-sur-Morges (CH)

( * ) Notice: Subject to any disclaimer, the term of this patent is extended or adjusted under 35 U.S.C. 154(b) by 0 days.

(21) Appl. No.: 10/373,673

(22) Filed: Feb. 24, 2003

(65) Prior Publication Data

US 2003/0174854 A1 Sep. 18, 2003

Related U.S. Application Data

(60) Provisional application No. 60/361,897, filed on Mar. 2, 2002.

(51) Int. Cl.[7] ..... H04R 25/00
(52) U.S. Cl. ..... 381/379; 381/374; 381/375
(58) Field of Search ..... 379/431, 433.01, 379/430; 381/377, 381, 375, 379, 374, 378, 383, 386, 370; 181/129

(56) References Cited

U.S. PATENT DOCUMENTS 5,790,683 A * 8/1998 Salzani ..... 381/370
5,903,644 A * 5/1999 Scheider et al. ..... 379/430
6,047,076 A * 4/2000 Yang ..... 381/381
6,580,800 B1 * 6/2003 Yamasaki et al. ..... 381/379

* cited by examiner

*Primary Examiner*—Curtis Kuntz
*Assistant Examiner*—Brian Ensey
(74) *Attorney, Agent, or Firm*—Ipsolon LLP

(57) ABSTRACT

A personal audio set, such as a headphone, earphone, or headset, that includes a pivoting clip-type mounting portion is disclosed. A pair of arms are pivotally secured to the mounting portion to define a substantially c-shape for engaging the ear-base of a wearer's ear. Each arm is pivotally secured to the mounting portion preferably at a common first pivot, and biased to a neutral position with respect to each other. The arms move apart from each other about the pivot when being installed or removed from an ear, and seek to return to their neutral positions when placed on an ear, thereby securing the personal audio set on the base of a wearer's ear. Preferably, the mounting portion is also pivotally secured to the personal audio set at a second pivot hat is substantially perpendicular to the first pivot and biased to a neutral position such that the audio set is biased against the wearer's ear. More preferably, the mounting portion and personal audio set have a longitudinal center line and are a mirror image along that center line thereby allowing the personal audio set to be detachably secured to either a wearer's left or right ears.

20 Claims, 4 Drawing Sheets

PERSONAL AUDIO-SET WITH PIVOTING EAR CLIP MOUNT

CROSS-REFERENCE TO RELATED APPLICATIONS

This application claims priority to U.S. provisional patent application No. 60/361,897 filed on Mar. 2, 2002, and to U.S. design application Ser. No. 29/161,949 filed on Jun. 5, 2002, and issued as U.S. Des. Pat. No. D470,836 on Feb. 25, 2003.

FIELD OF THE INVENTION

The present invention relates to a personal audio set that includes a pivoting ear clip mount.

BACKGROUND OF THE INVENTION

Personal audio-sets, commonly known as headphones, earphones, headsets, and the like, are gaining in popularity. The typical audio-set includes a frame containing an earphone which is usually positioned over or in a wearer's ear. In cases where the audio-set is a headset, a microphone is also typically positioned on the frame near the wearer's mouth.

It is important that the frame of the audio-set securely hold these components in their proper places with respect to the wearer, without being unduly heavy and without causing discomfort to the wearer. Historically, the frames of personal audio-sets have included a headband that the wearer positions over or behind their head to hold an earphone portion over one or both ears. However, some headband-type personal audio-sets inadvertently compress the wearer's head or ears thereby causing discomfort, particularly when the personal audio-set is worn for extended periods.

Personal audio-sets have been mounted to a wearer without using a headband. For example, some personal audio-set rely on ear plug-type mounts that are either physically wedged either into the wearer's ear canal or hooked on the intertragal notch of the wearer's ear as shown in U.S. Pat. No. 5,544,253 to Nagayoshi et al. However, the size of a wearer's ear and ear canal differ greatly between wearers. Accordingly, different sized ear plugs must typically be offered to account for these differences in ear and ear canal sizes. Moreover, since the entire weight of the assembly is supported by such a small portion of the ear, these types of mounts feel uncomfortable for some wearers.

More recently, headphones have been hooked around the base of a wearer's ear as shown in U.S. Pat. No. 5,625,171 to Marshall. However, these types of mounts are relatively bulky structures and some wearers feel discomfort supporting the personal audio-set in this matter. In addition, most ear hook designs do not easily lend themselves to being worn over either a wearer's left or right ear.

SUMMARY OF THE INVENTION

Accordingly, despite the available improvements offered by personal audio-set ear mounts, there remains a need for an ear clip type mount for a personal audio set that is light weight, not bulky, reversible, and comfortable to wear. In addition to other benefits that will become apparent in the following disclosure, the present invention fulfills these needs.

The present invention is a personal audio set, such as a headphone, earphone, or headset, that includes a pivoting clip-type mounting portion, the mounting portion includes two arms extending from a frame defining an ear clip. Each arm is pivotally secured to the frame, preferably at a common first pivot, and biased to a neutral position with respect to each other. The arms move apart from each other about their respective pivots when being installed or removed from an ear, and seek to return to their neutral positions when placed on an ear, thereby securing the personal audio set on the base of a wearer's ear.

Preferably, the mounting portion is also pivotally secured to the personal audio set at a second pivot that is substantially perpendicular to the first pivot and biased to a neutral position such that the audio set is biased against the wearer's ear.

More preferably, the mounting portion and personal audio set are shaped to fit on both a wearer's left and right ear.

DETAILED DESCRIPTION OF PREFERRED EMBODIMENTS

Figure 1:
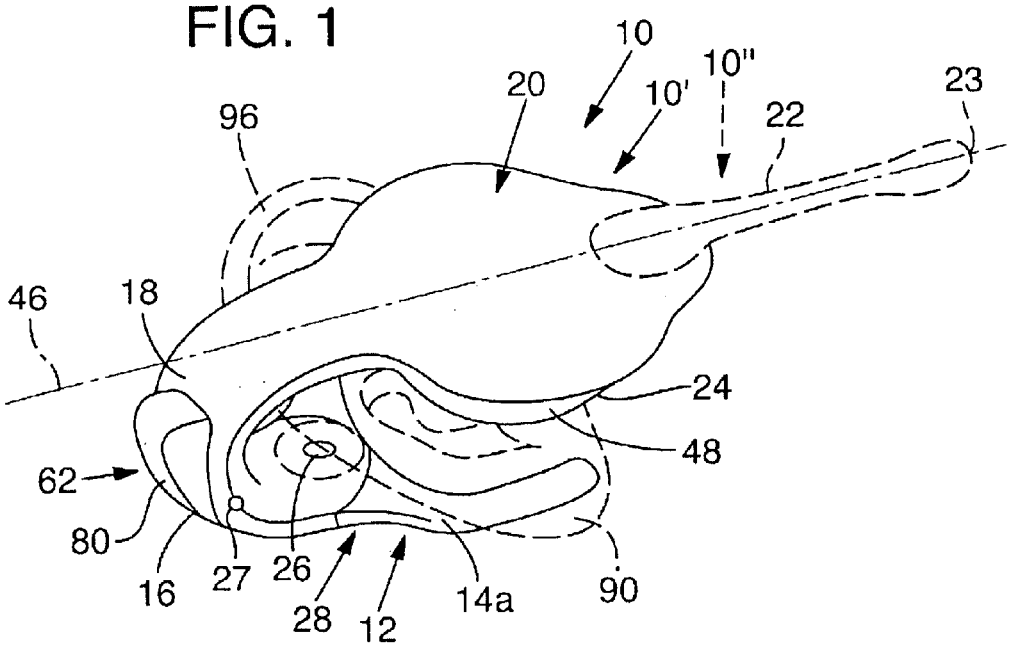
FIG. 1 is an isometric view of a personal audio set having independently pivoting ear clip arms in accordance with an embodiment of the present invention showing a possible mounting to a wearer's right ear, which is shown in hidden lines.

A personal audio set 10, such as a headphone, earphone, or headset, that includes an ear-clip mounting portion 12 that has at least two arms 14*a*, 14*b* pivotally secured to a frame 16 at a first pivot 26 for operably engaging the base 92 of a wearer's ear 90, and preferably, the frame 16 is pivotally secured the personal audio set 10 at a second pivot 27 is shown in FIGS. 1–8.

In a preferred embodiment shown in FIGS. 1–8, the personal audio set 10 is a headset 10" having a frame 16 containing an ear clip mounting portion 12, an intermediate portion 18, and an ear phone portion 20. The ear clip mounting portion 12 is operably secured to the base 92 of a wearer's ear 90. The intermediate portion 18 extends from the ear clip mounting portion 12 over the wearer's ear 90 and aligns the ear phone portion 20 over the wearer's ear canal 94. An optional boom microphone 22 can extend from the frame. If so, it is desirable for the tip 23 of the boom microphone 22 to be either over or directed toward the wearer's mouth (not shown). Preferably, the boom microphone 22 is pivotally secured to the frame.

The ear phone portion 20 preferably contains a speaker 24, and wiring (not shown) extends from the headset 10" to operably connect the headset 10" to an appropriate audio device (not shown). Alternatively, the earphone can include appropriate electronics to allow it to wirelessly connect with the audio device.

Figure 6A:
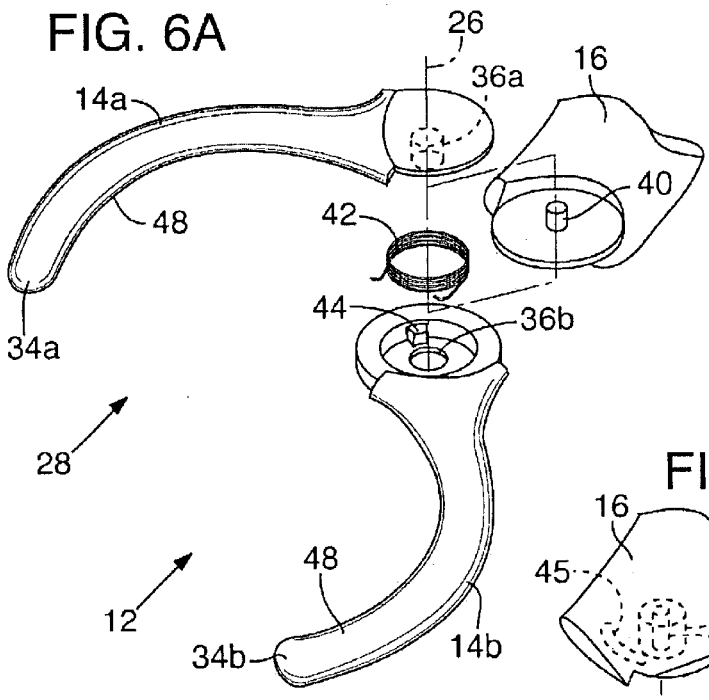
FIG. 6A is an enlarged, exploded view of the ear clip portion of the personal audio set of FIG. 4.

Preferably and as best shown in FIG. 6A, the ear clip mounting portion 12 includes a first arm 14*a* and a second arm 14*b* with each arm 14*a*, 14*b*, respectively, being pivotally secured to the frame 16. More preferably, the pivot axes of the two arms are coincident at pivot 26.

Figure 4:
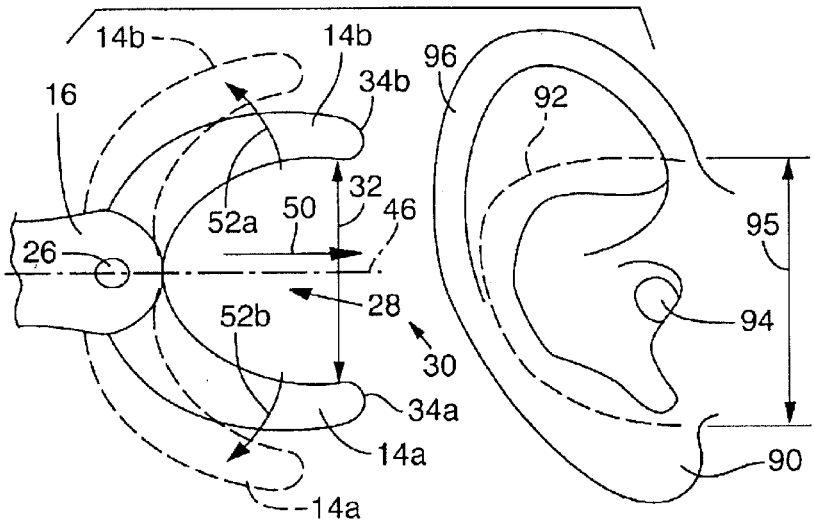
FIG. 4 is a fragmentary side view of the ear clip portion of the personal audio set of FIG. 3 showing a possible movement of the pivoting arms along a first pivot axis when being installed on an ear.

As best shown in FIG. 4, the arms 14*a*, 14*b* are curved such that they form an arcuate, substantially c-shaped griping portion 28 sized to encircle a portion of the base 92 of a wearer's ear 90. More preferably, the arms 14*a*, 14*b* are biased to a closed position 30 shown in FIG. 4 such that the distance 32 between the ends 34*a*, 34*b* of the two arms 14*a*, 14*b* is less than the corresponding thickness 95 of the wearer's ear base 92. Accordingly, the arms 14*a*, 14*b* securely grip the wearers' ear base 92 when the ear clip mounting portion 12 is installed on a wearer's ear 90.

An exemplar structure for biasing the arms 14*a*, 14*b* in this manner is shown in FIG. 6A. Each arm 14*a*, 14*b* includes a pivot hole 36*a*, 36*b*, respectively, for operably receiving a pivot pin 40, which extends from the frame 16. A coil spring 42 encircles the pivot pin 40 and operably engages stops 44 on each arm 14*a*, 14*b* such that the arms 14*a*, 14*b* are urged about the pivot pin 40 toward each other. The spring 42 is preferably sized so that undue force is not required to pivot the arms 14*a*, 14*b* about the pivot pin 40 from their closed position 30 (FIG. 4), but still allows the arms 14*a*, 14*b* to securely engage a wearer's ear 90 when mounted.

Figure 6B:
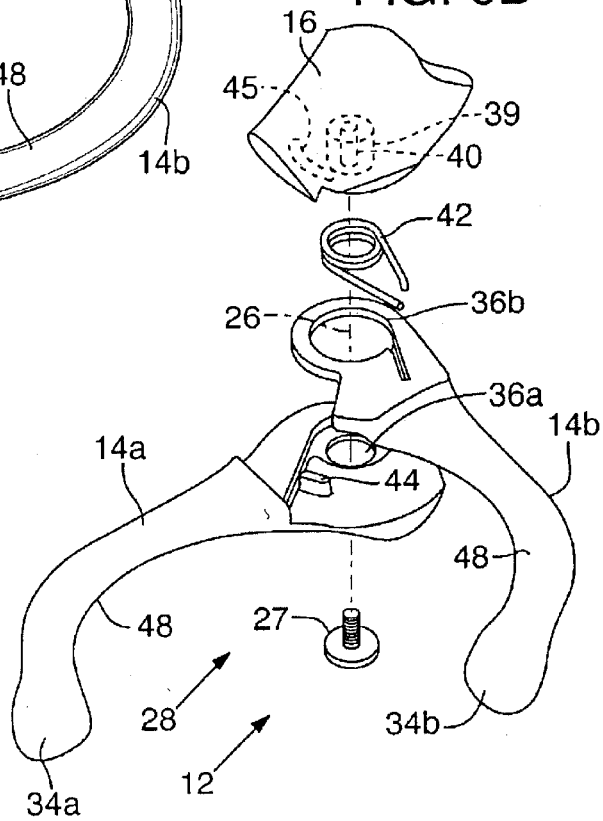
FIG. 6B is an enlarged, exploded view of an alternative preferred ear clip portion of a personal audio set.

Alternatively, and as shown in FIG. 6B, pivot pin 40 can extend from the frame 16 through both pivot holes 36*a*, 36*b* as shown. The outer diameter of arm 14*b* is substantially circular so as to pivotally engage a mating recess 39 in the frame 16. Arm 14*b* is pivotally secured to pivot pin 40. Preferably, fastener 27 pivotally secures the arms 14*a*, 14*b* to the frame 16. Stop (not shown) operably engages arm 14*a* to prevent arm 14*a* from pivoting past the stop. Similarly, slot 45 operably engages a mating protrusion 44 extending from arm 14*a* so as to limit the range of movement of arm 14*b* about the pivot pin 40. Coil spring 42 encircles the pivot pin 40 and operably engages the arms 14*a*, 14*b* so as to urge them toward each other about the pivot pin 40. Preferably, pivot hole 36*a* is larger that pivot hole 36*b* so as to receive the coil portion of the coil spring therein.

Figure 2:
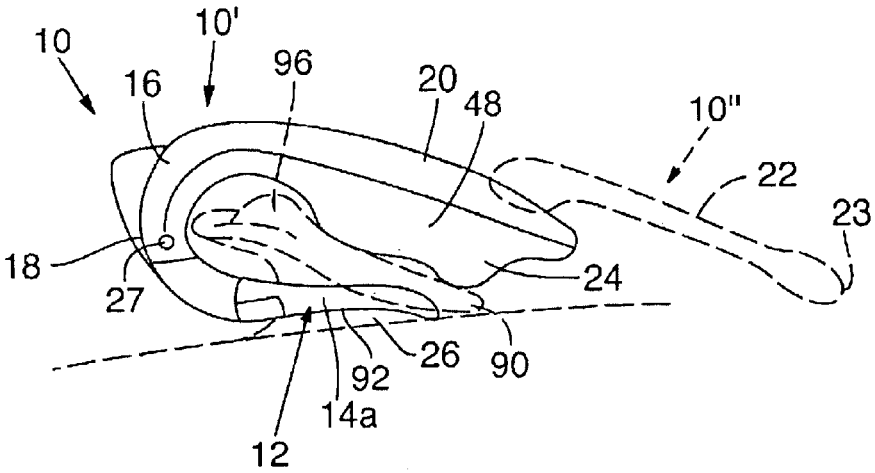
FIG. 2 is a top view of the personal audio set of FIG. 1, showing a possible mounting to a wearer's left ear and a possible boom microphone attachment, both of which are shown in hidden lines.
Figure 5:
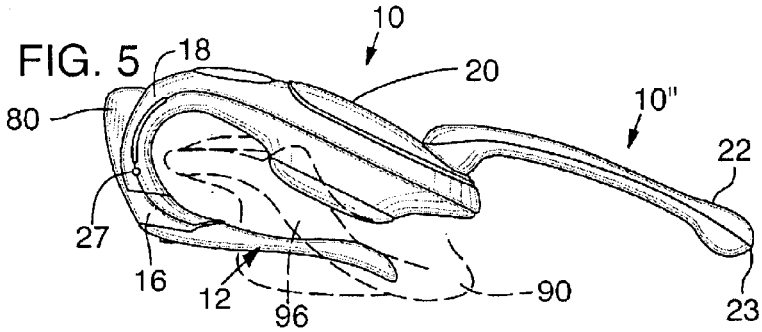
FIG. 5 is a bottom view of the personal audio set of FIG. 1, showing a possible mounting to a wearer's right ear and a possible boom microphone attachment.
Figure 7:
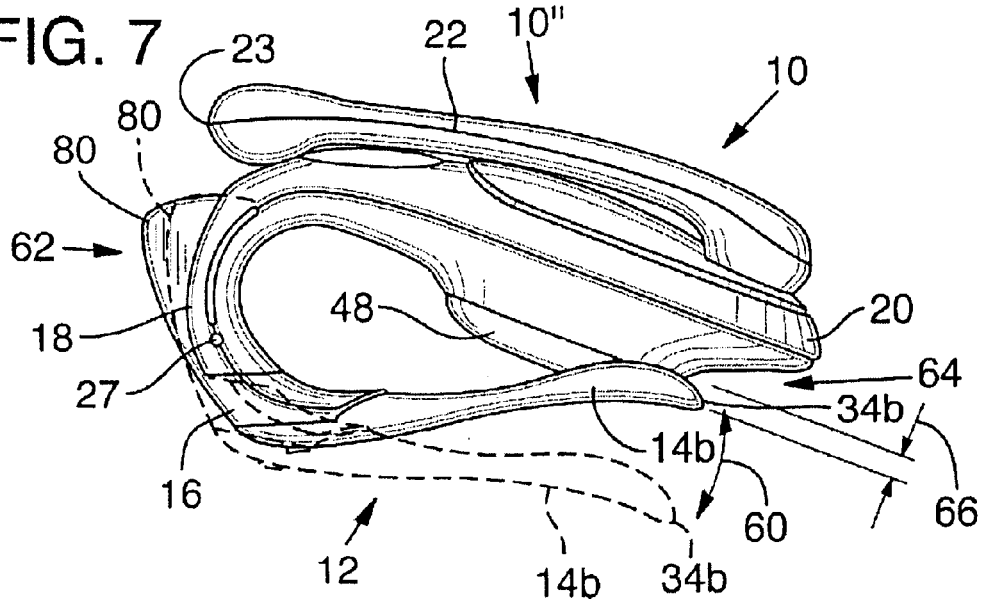
FIG. 7 is a top view of the personal audio set of FIG. 1 showing a possible movement along a second pivot axis.
Figure 8:
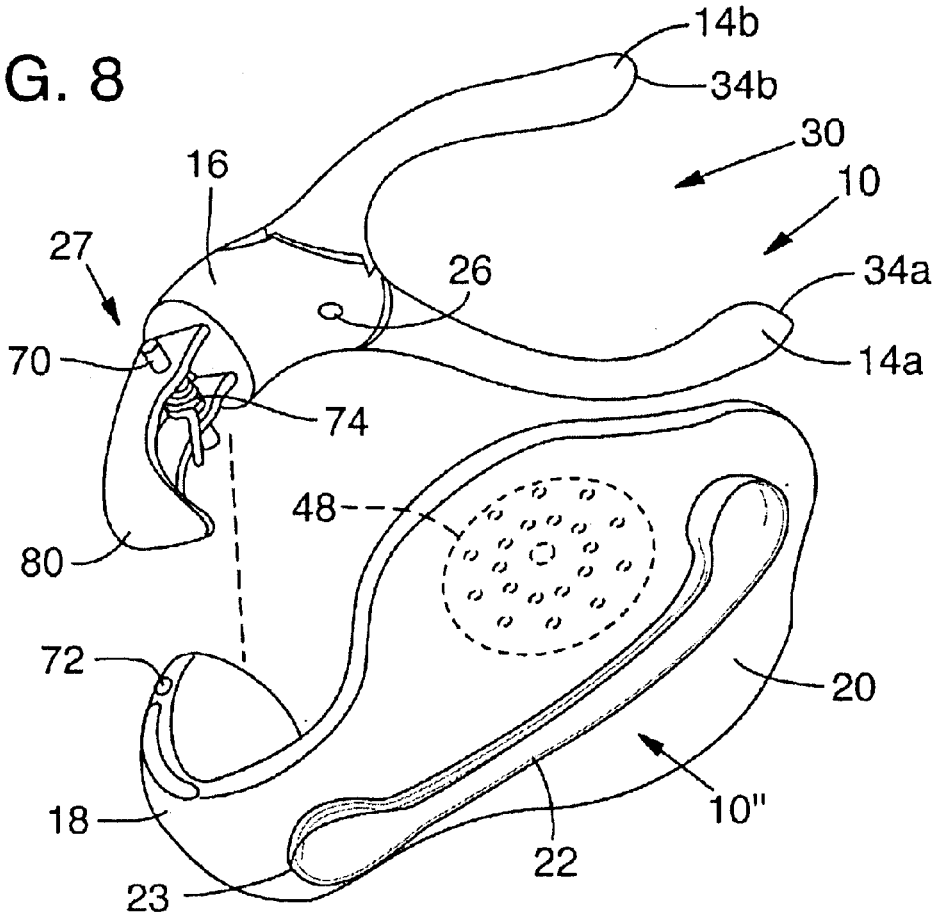
FIG. 8 is a fragmentary, isometric view of the personal audio set of FIG. 7, showing internal assembly details related to the second pivot axis.

As best shown in FIGS. 7 & 8, the intermediate portion 18 of the personal audio set 10 is preferably c-shaped and pivotally secured to the frame 16 at pivot 27. Preferably, pivot 27 is aligned substantially perpendicular to pivot 26 such that the ear clip mounting portion 12 is moveable in the direction of arrow 60 (FIG. 7). More preferably, the ear clip mounting portion 12 is biased to a neutral position 64, thereby further securing the ear phone portion 20 to the ear 90 as best shown in FIGS. 2 and 5. The neutral position 64 is preferably sized such that distance 66 between the ends 34*a*, 34*b* of the two arms 14*a*, 14*b* and the inner surface of the ear phone portion 20 is less than the thickness of the correspondingly engaging portions of the wearer's ear 90.

Referring to FIG. 8, the frame 16 preferably includes a pivot pin 70 for operably engaging mating pivot holes 72 on the intermediate portion 18 thereby defining the pivot 27. A biasing means, such as a coil spring 74, operably engages the frame 16 and intermediate portion 18 to urge the ear clip mounting portion 12 to its neutral position 64. The spring 74 is preferably sized so that undue force is not required to pivot the ear clip mounting portion 12 about the pivot pin 70, but still allows the ear phone portion 20 to comfortably and securely engage a wearer's ear 90.

More preferably, the frame 16 includes a lever arm portion 80 extending from the pivot pin thereby defining a lever arm opposite the ear clip mounting portion. As best shown in FIG. 7, the lever arm extends from the intermediate portion 18 such that moving the lever arm 80 in the direction of arrow 62 (FIG. 7) urges the ear clip mounting portion 12 to pivot away from its neutral position 64 and thereby release the personal audio set 10 from the wearer's ear 90.

The headset 10" can be designed to have a mirror image shape about its longitudinal axis 46 as best shown in FIG. 1. Accordingly, the headset 10" and ear-clip mounting portion 12 operate equally well and can be easily mounted to either a left or right ear of a wearer.

If desired, the ear engaging portions of the ear-clip mounting portion 12 and ear phone portion 20 can include appropriate padding 48 to further improve the comfort of the personal audio set 10.

Figure 3:
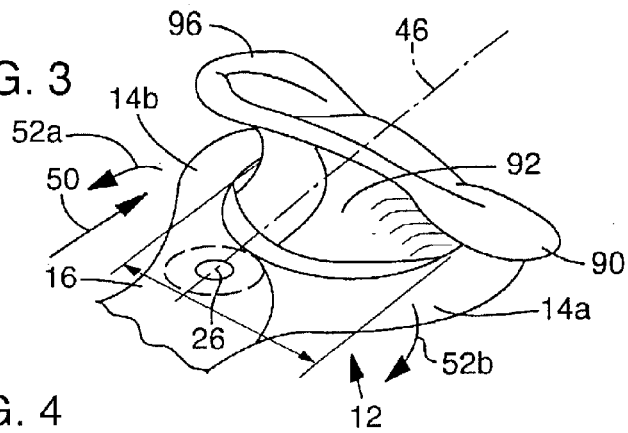
FIG. 3 is a fragmentary, isometric rear view of the ear clip portion of the personal audio set of FIG. 1 showing a possible engagement with a wearer's right ear.

A user mounts the personal audio set 10 to their ear 90 by positioning the substantially c-shaped gripping portion 28 behind either their left of right ear 90 so that the ends 34*a*, 34*b* of the arms 14*a*, 14*b* are pointing toward the ear 90 as shown in FIG. 5 and depressing the lever arm in the direction of arrow 62 (FIG. 7). The wearer than slides the frame 16 in the direction of arrow 50 (FIG. 4) toward the base 92 of their ear 90 such that the arms 14*a*, 14*b* contact the ear's base 92. This contact forces the arms 14*a*, 14*b* to pivot away from each other about the pivot pin 40, thereby urging the arms 14*a*, 14*b* in the direction of arrows 52*a*, 52*b*, respectively. The wearer keeps sliding the arms 14*a*, 14*b* across the base 92 of their ear 90 such that the arms 14*a*, 14*b* travel on different sides of the base 92 of the ear with the ear phone portion 20 sliding over the pinna 96 of the wearer's ear. When the frame 16 is positioned adjacent to the base 92 of their ear 90 as shown in FIG. 3, the wearer releases the personal audio set 10, thereby allowing the ear clip mounting portion to seek its neutral position. The biasing force on the arms 14*a*, 14*b*, urges the arms 14*a*, 14*b* to securely grip the base 92 of the wearer's ear 90, thereby holding the personal audio set 10 in place on the wearer's ear 90.

To remove the personal audio set 10 from the wearer' ear 90, the wearer simply reverses this process by depressing the lever arm 80 and sliding the frame 16 away from their ear in an opposite direction from arrow 50 (FIG. 4), thereby urging the arms 14*a*, 14*b* to open and release the ear 90.

An alternative preferred embodiment of the personal audio set 10 is also shown in FIGS. 1–2. In this embodiment the personal audio set 10 is an earphone 10' without a boom microphone extending therefrom. The earphone 10' has an ear-clip mounting portion 12 that has at least two arms 14*a*, 14*b* pivotally secured to a frame 16 for operably engaging the base of a wearer's ear.

If desired, separate earphones 10' can be secured in both the right and left ears of the wearer, thereby providing stereo sound to the wearer, and allowing the two earphones 10' to operate like a pair of headphones.

Having described and illustrated the principles of our invention with reference to a preferred embodiment thereof, it will be apparent that the invention can be modified in arrangement and detail without departing from such principles. In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

I claim:

1. A personal audio set for detachably securing to the ear of a wearer comprising:

a frame containing an audio component; and, a mounting portion operably secured to the frame, said mounting portion having at least two arms extending therefrom and defining an ear base griping portion, each said arm being independently pivotally secured to the frame such that each arm may be individually pivoted about the frame without requiring pivotal movement of the other of each said arm thereby allowing the at least two arms to operably engaging the base of the wearer's ear.

2. The personal audio set for detachably securing to the ear of a wearer of claim 1, wherein said arms are biased to a neutral position.

3. The personal audio set for detachably securing to the ear of a wearer of claim 2, wherein said arms form a substantially c-shape.

4. The personal audio set for detachably securing to the ear of a wearer of claim 1, wherein said personal audio set has a longitudinal axis, and said frame is a mirror image about said longitudinal axis.

5. The personal audio set for detachably securing to the ear of a wearer of claim 1, wherein said arms are the same shape and length.

6. The personal audio set for detachably securing to the ear of a wearer of claim 1 , wherein said arms are pivotally secured to the frame at the same axis of rotation defining a first pivot axis.

7. The personal audio-set for detachably securing to the ear of a wearer of claim 6, wherein said mounting portion is pivotally secured to said frame at a second pivot axis.

8. The personal audio-set for detachably securing to the ear of a wearer of claim 7, wherein said mounting portion is biased to a neutral position with respect said frame at said second pivot axis.

9. The personal audio-set for detachably securing to the ear of a wearer of claim 7, wherein said first pivot axis and said second pivot axis are aligned substantially perpendicular to each other.

10. The personal audio-set for detachably securing to the ear of a wearer of claim 1, wherein said mounting portion including an intermediate section, said intermediate section being substantially c-shaped.

11. The personal audio-set for detachably securing to the ear of a wearer of claim 1, wherein said personal audio-set is a headset.

12. The personal audio-set for detachably securing to the ear of a wearer of claim 11, wherein said headset includes an elongate boom microphone pivotally secured to said frame.

13. The personal audio-set for detachably securing to the ear of a wearer of claim 1, wherein said personal audio-set is a headphone.

14. The personal audio-set for detachably securing to the ear of a wearer of claim 7, wherein said mounting portion includes a lever arm extending from said second pivot for pivoting said mounting portion.

15. A mount for detachably securing a personal audio set to the ear base of a wearer, said mount comprising:

a frame having a mounting portion pivotally secure to an intermediate portion at a first pivot axis; and a pair of ear base engaging arms defining a substantially c-shape, each arm of said pair of ear base engaging arms individually pivotally secured to said mounting portion and extending from said mounting portion such that each arm may be individually pivoted about the mounting portion without requiring pivotal movement of the other of each said arm.

16. The mount of claim 15, wherein said pair of arms are pivotally secured to a second pivot axis.

17. The mount of claim 16, wherein said first pivot axis is substantially perpendicular to said second pivot axis.

18. The mount of claim 16, wherein said mount has a longitudinal center line about said second pivot axis, and said pair of ear base engaging arms define a mirror image about said longitudinal center line thereby allowing the mount to be operably secured to either a wearer's left or right ear base.

19. The mount of claim 15, wherein said intermediate portion includes a lever arm extending from said first pivot axis, said lever arm extending from said frame for pivoting said intermediate portion about said first pivot axis.

20. The mount of claim 15, wherein said intermediate portion is substantially c-shaped.

* * * * *